US008690996B2

(12) United States Patent
Jl et al.

(10) Patent No.: US 8,690,996 B2
(45) Date of Patent: Apr. 8, 2014

(54) ELECTRIC PRECIPITATOR AND ELECTRODE PLATE THEREOF

(75) Inventors: Jun Ho Jl, Namyangju-si (KR); In Sang Hwang, Hwaseong-si (KR); Hyong Soo Noh, Yongin-si (KR); Byeong Cheol Yoon, Suwon-si (KR); Kochiyama Yasuhiko, Seongnam-si (KR); Du Seop Yoon, Seongnam-si (KR); So Young Yun, Suwon-si (KR); Jun Young Lee, Daejeon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 481 days.

(21) Appl. No.: 12/929,508

(22) Filed: Jan. 28, 2011

(65) Prior Publication Data

US 2011/0185905 A1 Aug. 4, 2011

(30) Foreign Application Priority Data

Jan. 29, 2010 (KR) ..... 10-2010-0008390

(51) Int. Cl.
*B03C 3/08* (2006.01)

(52) U.S. Cl.
USPC ..... 96/69; 95/79; 96/76; 96/79; 96/98; 96/99

(58) Field of Classification Search
USPC ..... 96/69, 75–79, 83, 84, 86–88, 96, 98, 96/99; 95/79
See application file for complete search history.

(56) References Cited

U.S. PATENT DOCUMENTS

| | | | | | |
|---|---|---|---|---|---|
| 3,026,964 | A * | 3/1962 | Penney | ..... | 96/74 |
| 4,231,766 | A * | 11/1980 | Spurgin | ..... | 96/79 |
| 5,302,190 | A * | 4/1994 | Williams | ..... | 95/57 |
| 5,766,318 | A * | 6/1998 | Loreth et al. | ..... | 96/69 |
| 5,993,521 | A * | 11/1999 | Loreth et al. | ..... | 96/69 |
| 6,090,189 | A * | 7/2000 | Wikstrom et al. | ..... | 96/69 |
| 7,077,890 | B2 | 7/2006 | Botvinnik | | |
| 2008/0314250 | A1 * | 12/2008 | Cowie et al. | ..... | 96/86 |

FOREIGN PATENT DOCUMENTS

| | | | | |
|---|---|---|---|---|
| JP | 54-136476 A | * 10/1979 | ..... | 96/79 |
| JP | 6-165949 | 6/1994 | | |
| KR | 10-2008-0063011 | 7/2008 | | |

* cited by examiner

*Primary Examiner* — Richard L Chiesa
(74) *Attorney, Agent, or Firm* — Staas & Halsey LLP

(57) ABSTRACT

An electric precipitator to collect contaminants, such as dust, using electrical attraction. The electric precipitator includes high-voltage electrode plates and low-voltage electrode plates alternately stacked to form an electrification region and a collection region in an air flow direction, wherein each of the high-voltage electrode plates includes a discharge electrode to generate discharge between the discharge electrode and an opposite electrode so that contaminants are electrified in the electrification region and a collection electrode disposed over the electrification region and the collection region to collect the electrified contaminants in the collection region.

10 Claims, 10 Drawing Sheets

ELECTRIC PRECIPITATOR AND ELECTRODE PLATE THEREOF

CROSS-REFERENCE TO RELATED APPLICATIONS

This application claims the benefit of Korean Patent Application No. 2010-0008390, filed on Jan. 29, 2010 in the Korean Intellectual Property Office, the disclosure of which is incorporated herein by reference.

BACKGROUND

1. Field

Embodiments relate to an electric precipitator to collect contaminants, such as dust, using electrical attraction.

2. Description of the Related Art

In general, an electric precipitator is mounted in an air conditioner, etc. The electric precipitator is disposed in an air flow channel to collect contaminants, such as dust, from air passing therethrough using electrical attraction.

Generally, the electric precipitator collects contaminants using a two-stage electric precipitation structure including an electrification unit disposed at an upstream side in an air flow direction to electrify contaminants and a collection unit disposed at a downstream side in the air flow direction to collect the electrified contaminants using electrical attraction.

In the electric precipitator having the two-stage electric precipitation structure, the electrification unit includes a discharge wire forming a plus pole and a pair of opposite electrode plates disposed spaced a regular height from the discharge wire to form a minus pole, and the collection unit includes a plurality of high-voltage collection electrode plates and a plurality of ground electrode plates which are alternately disposed.

In the conventional electric precipitator, however, high voltage is applied to the discharge wire so as to generate discharge between the discharge wire and the ground electrode plates. Therefore, a large-capacity power supply is provided to apply high voltage, and a large amount of power is consumed.

Since high voltage is applied to the discharge wire as described above, the discharge wire and the collection unit are greatly spaced apart from each other in consideration of safety. As a result, it may be difficult to reduce the size of the electric precipitator.

SUMMARY

It is an aspect to provide an electric precipitator having a thinner size, thereby more efficiently achieving space utilization, and an electrode plate thereof.

It is another aspect to provide an electric precipitator having an electrode layer using even an electrification region as a collection electrode, thereby improving electrification efficiency of contaminants, such as dust, and an electrode plate thereof.

It is another aspect to provide an electric precipitator wherein a space between neighboring electrodes is increased, thereby reducing the total number of electrode plates, and an electrode plate thereof.

It is a further aspect to provide an electric precipitator wherein a space between electrodes is relatively increased, thereby reducing pressure loss and achieving large air flow.

Additional aspects will be set forth in part in the description which follows and, in part, will be apparent from the description, or may be learned by practice of the invention.

In accordance with one aspect, an electric precipitator includes high-voltage electrode plates and low-voltage electrode plates alternately stacked to form an electrification region and a collection region in an air flow direction, wherein each of the high-voltage electrode plates includes a discharge electrode to generate discharge between the discharge electrode and an opposite electrode so that contaminants are electrified in the electrification region and a collection electrode disposed over the electrification region and the collection region to collect the electrified contaminants in the collection region.

Each of the high-voltage electrode plates may include first and second film members, formed of an insulative material, attached to each other, first electrode layers provided at outer surfaces of the first and second film members to form the discharge electrode, and a second electrode layer provided between the first and second film members to form the collection electrode.

Each of the high-voltage electrode plates may include first and second film members, formed of an insulative material, attached to each other and an electrode layer provided between the first and second film members in a state in which portions of the electrode layer protrude outward from the first and second film members to form the discharge electrode and the collection electrode.

The first electrode layers may be carbon-ink printed on the outer surfaces of the first and second film members.

The second electrode layer may be disposed so that one end of the second electrode layer is adjacent to the first electrode layers.

The second electrode layer may include a first part formed at a downstream side in the air flow direction from a straight line connecting one end of the first electrode layer formed at the first film member and one end of the first electrode layer formed at the second film member.

The second electrode layer may further include a second part formed at an upstream side in the air flow direction from the straight line.

The second electrode layer may be disposed so that at least a portion of the second electrode layer faces the first electrode layers in a direction in which the high-voltage electrode plates are stacked.

The electrode layer may include a first part forming the discharge electrode at a protruding end having a length of several mm or less and a second part forming the collection electrode at the remaining portion excluding the protruding end.

The electrode layer may be formed of a conductive fiber.

In accordance with another aspect, an electric precipitator includes a high-voltage electrode plate and a low-voltage electrode plate disposed spaced apart from each other to form an electrification region and a collection region in an air flow direction, wherein the high-voltage electrode plate includes a first high-voltage electrode plate, having a discharge electrode and a collection electrode, disposed in the electrification region and the collection region and a second high-voltage electrode plate, having only a collection electrode, disposed in the collection region, the low-voltage electrode plate includes a first low-voltage electrode plate, having an opposite electrode and a ground electrode corresponding to the first high-voltage electrode plate, disposed in the electrification region and the collection region and a second low-voltage electrode plate, having only a ground electrode corresponding to the second high-voltage electrode plate, disposed in the collection region, and an electric field formed between the collection electrode of the first high-voltage electrode plate and the ground electrode of the first low-voltage electrode plate increases intensity of an electric field formed between the discharge electrode of the first high-voltage electrode plate and the opposite electrode of the first low-voltage electrode plate in the electrification region.

The collection electrode of the first high-voltage electrode plate may be disposed in the electrification region.

The discharge electrode of the first high-voltage electrode plate may be formed by first electrode layers carbon-ink printed on outer surfaces of a pair of plastic resins, and the collection electrode of the first high-voltage electrode plate may be formed by a second electrode layer disposed between the plastic resins so that the second electrode layer is adjacent to the first electrode layers.

The discharge electrode of the first high-voltage electrode plate may be formed by a protruding end of an electrode layer disposed between a pair of plastic resins, and the collection electrode of the first high-voltage electrode plate may be formed by the remaining portion of the electrode layer excluding the protruding end.

The second high-voltage electrode plate and the second low-voltage electrode plate may be disposed between the first high-voltage electrode plate and the first low-voltage electrode plate in at least one pair.

In accordance with a further aspect, a high-voltage electrode plate includes a discharge electrode disposed at an upstream side in an air flow direction to discharge contaminants and a collection electrode extending from the upstream side to a downstream side in the air flow direction to increase intensity of an electric field formed by the discharge electrode and to collect electrified contaminants.

The high-voltage electrode plate may include first and second film members, formed of an insulative material, attached to each other, first electrode layers printed on outer surfaces of the first and second film members to form the discharge electrode, and a second electrode layer provided between the first and second film members to form the collection electrode.

The high-voltage electrode plate may include first and second film members, formed f an insulative material, attached to each other and an electrode layer provided between the first and second film members in a state in which portions of the electrode layer protrude outward from the first and second film members to form the discharge electrode and the collection electrode.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
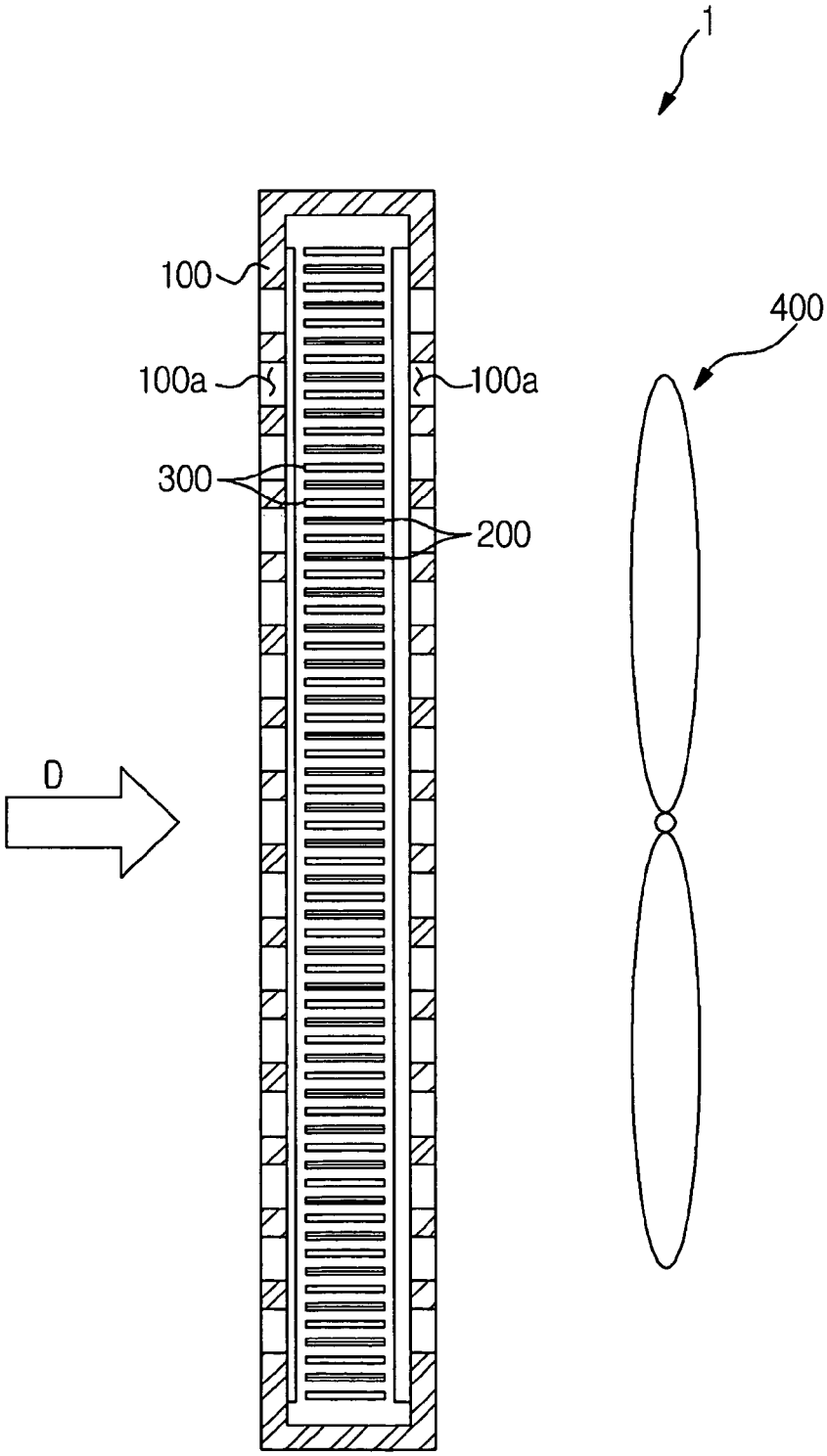
FIG. 1 is a perspective view illustrating an electric precipitator according to an embodiment.

Reference will now be made in detail to the embodiments, examples of which are illustrated in the accompanying drawings, wherein like reference numerals refer to like elements throughout.

Figure 2:
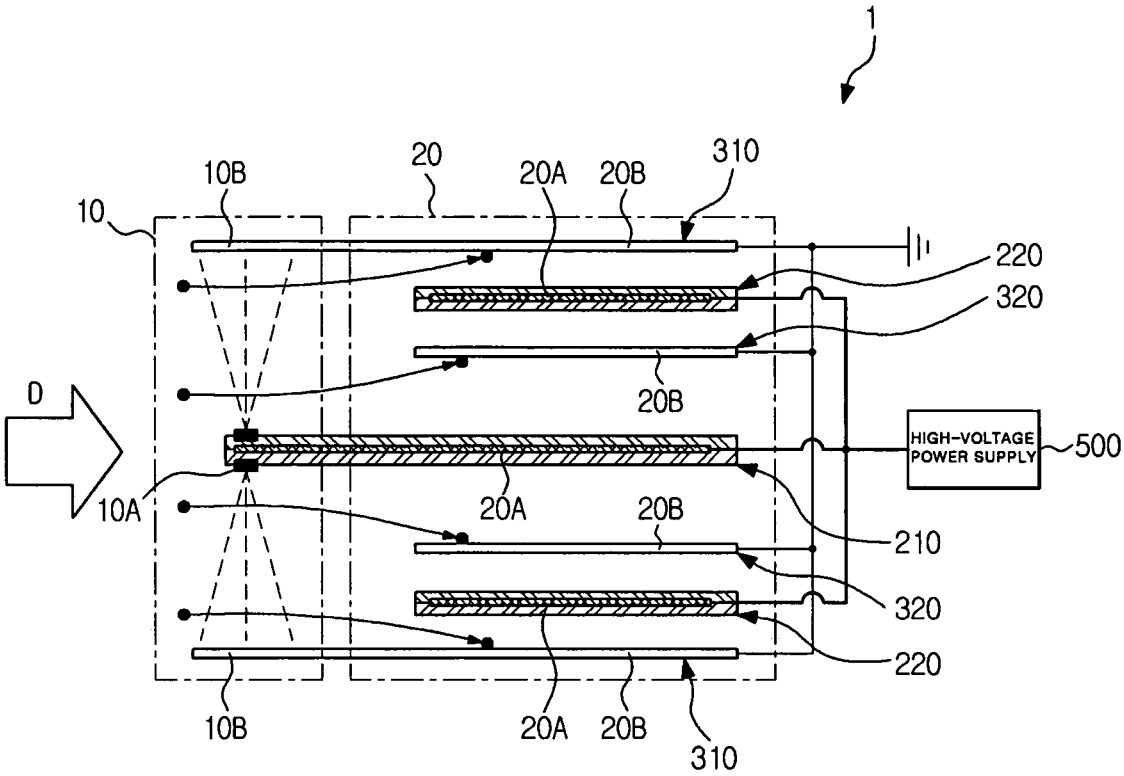
FIG. 2 is a schematic view illustrating the arrangement state of a high-voltage electrode and a low-voltage electrode applied to the electric precipitator of FIG. 1.

FIG. 1 is a perspective view illustrating an electric precipitator according to an embodiment, and FIG. 2 is a schematic view illustrating the arrangement state of a high-voltage electrode and a low-voltage electrode applied to the electric precipitator of FIG. 1.

As shown in FIGS. 1 and 2, an electric precipitator 1 according to an embodiment is an apparatus which is disposed in an air flow channel to collect contaminants, such as dust, contained in air. The electric precipitator 1 includes a frame 100, forming the external appearance of the electric precipitator 1, having grid-type through holes 100*a* through which air flows in one direction, a plurality of high-voltage electrode plates 200 disposed in the frame 100 to collect contaminants, such as dust, and a plurality of low-voltage electrode plates 300 disposed in the frame 100 so that the low-voltage electrode plates 300 correspond to the high-voltage electrode plates 200.

In this embodiment, the high-voltage electrode plates 200 and the low-voltage electrode plates 300 are alternately stacked at regular intervals to form an electrification region 10 and a collection region 20 in an air flow direction D.

Each of the high-voltage electrode plates 200 has a discharge electrode 10A to which high voltage is applied to electrify contaminants contained in air in the electrification region 10 and a collection electrode 20A to which high voltage is applied to collect the electrified contaminants in the collection region 20. Here, the discharge electrode 10A and the collection electrode 20A may be connected to different high-voltage power supplies 500.

Also, each of the low-voltage electrode plates 300 has an opposite electrode 10B disposed spaced a regular distance from a corresponding discharge electrode 10A to form corona discharge in the electrification region 10 and a ground electrode 20B grounded to form a regular electric field between the collection electrode 20A and the ground electrode 20B in the collection region 20.

That is, the high-voltage electrode plates 200 serve as discharge electrodes and collection electrodes of an electric precipitator having a two-stage electric precipitation structure, and the low-voltage electrode plates 300 serve as opposite electrodes and ground electrodes of an electric precipitator having a two-stage electric precipitation structure.

The high-voltage electrode plates 200 include first high-voltage electrode plates 210 each having a discharge electrode 10A and a collection electrode 20A and second high-voltage electrode plates 220 each having only a collection electrode 20A.

Also, the low-voltage electrode plates 300 include first low-voltage electrode plates 310 each having an opposite electrode 10B and a ground electrode 20B corresponding to each of the first high-voltage electrode plates 210 and second low-voltage electrode plates 320 each having only a ground electrode 20B corresponding to each of the second high-voltage electrode plates 220.

Each of the second high-voltage electrode plates 220 and each of the second low-voltage electrode plates 320 form a pair. At least one pair of second high-voltage and low-voltage electrode plates 220 and 320 is disposed between a first high-voltage electrode plate 210 and a first low-voltage electrode plate 310.

For example, as shown in FIG. 2, a pair of second high-voltage and low-voltage electrode plates 220 and 320 may be disposed between a first high-voltage electrode plate 210 and a first low-voltage electrode plate 310.

Here, the first high-voltage electrode plate 210 and the first low-voltage electrode plate 310 are longer, by as much as the length of the electrification region 10, than the second high-voltage electrode plate 220 and second low-voltage electrode plate 320.

When high voltage from the high-voltage power supply 500 is applied to the first high-voltage electrode plate 210 and the second high-voltage electrode plate 220, therefore, the first and second high-voltage electrode plate 210 and 220 and the first and second low-voltage electrode plate 310 and 320 of the electric precipitator 1 form the electrification region 10 where dust particles in air are electrified and the collection region 20 where the dust particles electrified in the electrification region 10 are collected.

In this embodiment, therefore, the electric precipitator 1 does not have a space in which discharge electrode plates and ground electrode plates applied to an electric precipitator having a two-stage electric precipitation structure are installed, whereby the size of the electric precipitator 1 is greatly reduced.

Figure 3:
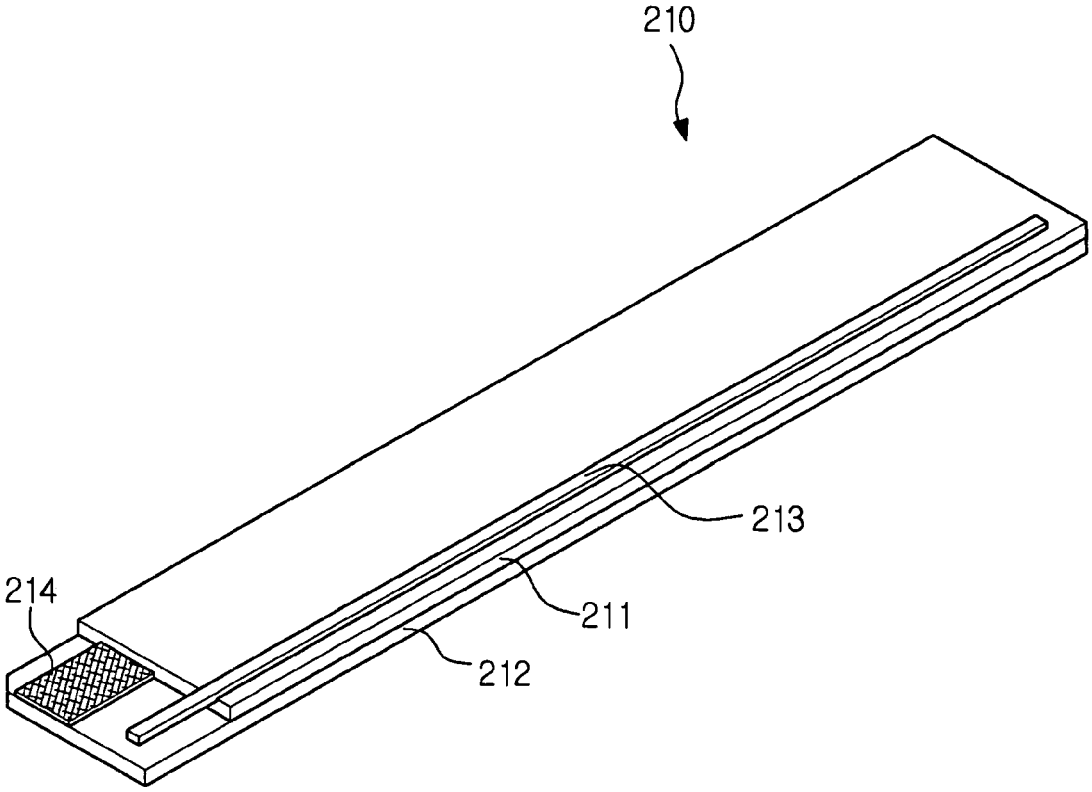
FIG. 3 is a perspective view of a first high-voltage electrode plate shown in FIG. 2.
Figure 4:
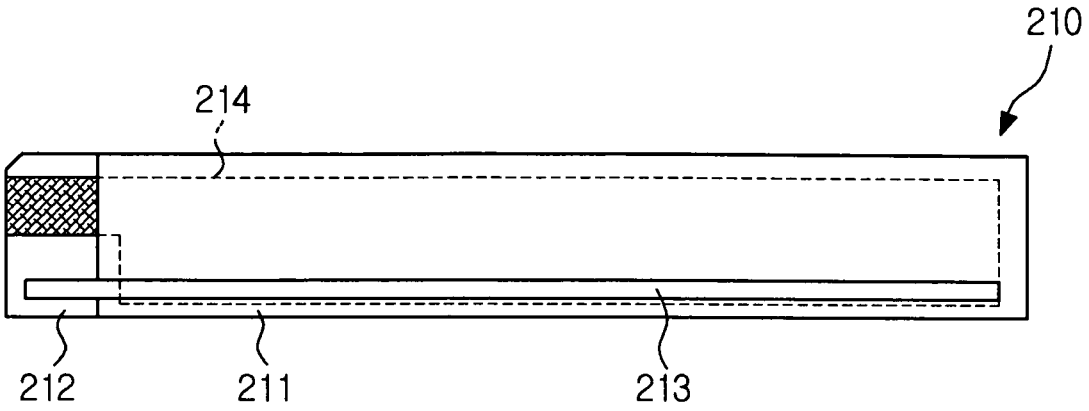
FIG. 4 is a plan view of the first high-voltage electrode plate shown in FIG. 3.
Figure 5:
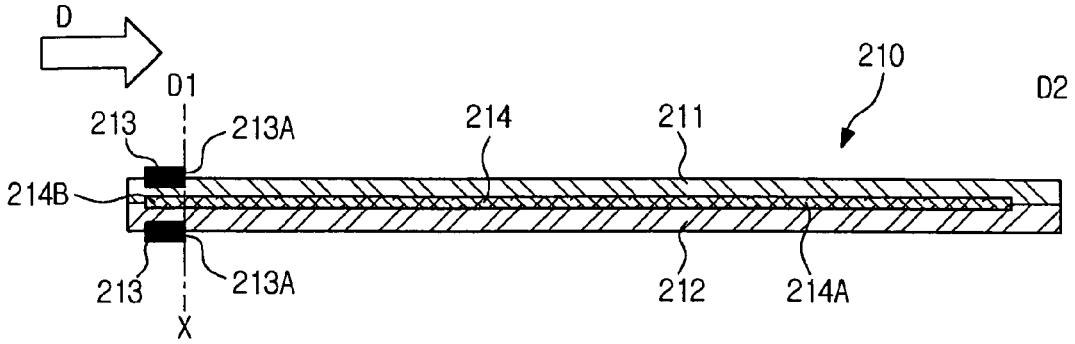
FIG. 5 is a side view of the first high-voltage electrode plate shown in FIG. 3.

FIG. 3 is a perspective view of a first high-voltage electrode plate shown in FIG. 2, FIG. 4 is a plan view of the first high-voltage electrode plate shown in FIG. 3, and FIG. 5 is a side view of the first high-voltage electrode plate shown in FIG. 3.

As shown in FIGS. 2 to 5, the first high-voltage electrode plate 210 includes first and second film members 211 and 212, formed of an insulative material, attached to each other, first electrode layers 213 provided at outer surfaces of the first and second film members 211 and 212 to form a discharge electrode 10A, and a second electrode layer 214 provided between the first and second film members 211 and 212 to form a collection electrode 20A.

As shown in FIG. 5, the first electrode layers 213 are disposed at an upstream side D1 in the air flow direction to discharge contaminants, such as dust. The first electrode layers 213 may be carbon-ink printed on the outer surfaces of the first and second film members 211 and 212.

The second electrode layer 214 extends from the upstream side D1 to a downstream side D2 in the air flow direction between first and second film members 211 and 212 to collect contaminants, such as dust, electrified by the first electrode layers 213.

The second electrode layer 214 is disposed so that one end of the second electrode layer 214 at the upstream side D1 in the air flow direction is adjacent to the first electrode layers 213.

For example, the second electrode layer 214 may include a first part 214A disposed at the downstream side D2 in the air flow direction from an imaginary line X connecting one end 213A of the first electrode layer 213 formed at the first film member 211 and one end 213A of the first electrode layer 213 formed at the second film member 212 and a second part 214B disposed at the upstream side D1 in the air flow direction from the imaginary line X.

That is, at least a portion of the second electrode layer 214 faces the first electrode layers 213 in the direction in which the high-voltage electrode plates 200 are stacked. When high voltage is applied to the second electrode layer 214, an electric field formed at the first part 214*a* as well as the second part 214B of the second electrode layer 214 affects the first electrode layers 213, thereby increasing an amount of contaminants, such as dust, electrified.

Therefore, the first electrode layers 213 constituting the discharge electrode 10A as well as the second electrode layer 214 constituting the collection electrode 20A are disposed in the electrification region 10 where contaminants, such as dust, are electrified, thereby improving particle electrification efficiency.

Figure 6:
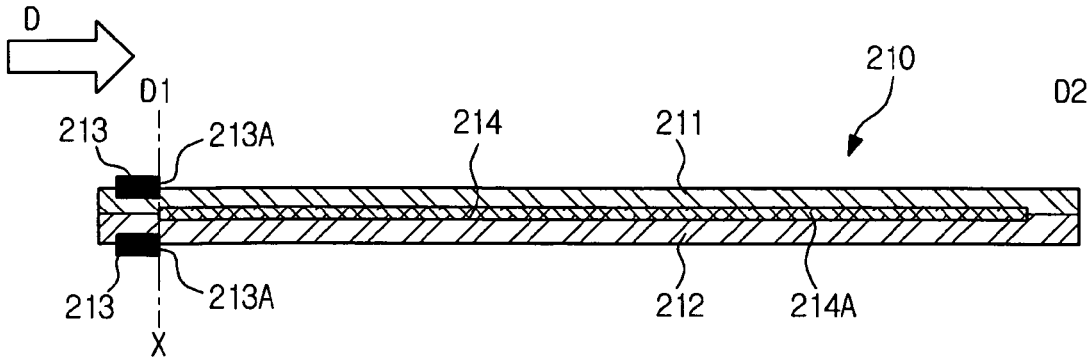
FIG. 6 is a side view illustrating a modification of the first high-voltage electrode plate shown in FIG. 3.

On the other hand, as shown in FIG. 6, the second electrode layer 214 may include only a first part 214A disposed at the downstream side D2 in the air flow direction from an imaginary line X connecting one end 213A of the first electrode layer 213 formed at the first film member 211 and one end 213A of the first electrode layer 213 formed at the second film member 212.

Even in this case, the first part 214*a* of the second electrode layer 214 constituting the collection electrode 20A affects the first electrode layers 213 constituting the discharge electrode 10A, thereby improving particle electrification efficiency in the electrification region 10.

Consequently, the distance between a first high-voltage electrode plate 210 including first electrode layers 213 constituting a discharge electrode 10A and a corresponding second low-voltage electrode plate 320 may be increased. As a result, the number of electrode plates 210, 220, 310 and 320 disposed in the electric precipitator 1 may be decreased, thereby reducing material costs and pressure loss.

For example, on the assumption that the distance between a second high-voltage electrode plate 220 and a corresponding first low-voltage electrode plate 310 or between a second high-voltage electrode plate 220 and a corresponding second low-voltage electrode plate 320 shown in FIG. 2 is L, the distance between a first high-voltage electrode plate 210 and a corresponding second low-voltage electrode plate 320 may be 1.2 L to 1.5 L.

Also, decrease of particle electrification efficiency is slight in spite of increase of flow rate. Consequently, dust electrification efficiency may be improved even in a fast sectional flow rate condition of 2.5 m/sec or more, thereby providing a high-efficiency, high-airflow dust collection system.

Hereinafter, a process of electrifying and collecting contaminants, such as dust, through the high-voltage electrode plates and the low-voltage electrode plates will be described.

First, when positive high voltage from the high-voltage power supply 500 is applied to the first and second high-voltage electrode plates 210 and 220, corona discharge occurs between the first electrode layers 213 of the first high-voltage electrode plate 210 constituting the discharge electrode 10A and the low-voltage electrode plate 300 with the result that contaminants contained in air passing through the electrification region 10 are positively electrified.

At this time, an electric field generated from the second electrode layer 214 of the first high-voltage electrode plate 210 constituting the collection electrode 20A affects the electrification region 10, thereby increasing the intensity of the electric field in the electrification region 10. As a result, particle electrification efficiency is improved, and therefore, particles electrified while passing through the electrification region 10 move a long distance.

Upon moving to the collection region 20 via the electrification region 10 together with air, the positively electrified contaminants, such as dust, move to the low-voltage electrode plate 300, to which relatively low voltage is applied, and are collected by the ground electrode 20B of the low-voltage electrode plate 300.

Meanwhile, voltage supplied from the high-voltage power supply 500 may be positive or negative. Also, the high-voltage power supply 500 may supply pulse voltage. Unexplained reference numeral 400 indicates a blowing unit to form air flow in the electric precipitator.

Another embodiment will be described with reference to FIGS. 7 to 10. Components of this embodiment identical to those of the previous embodiment are denoted by the same reference numerals, and a description thereof will not be given.

Figure 7:
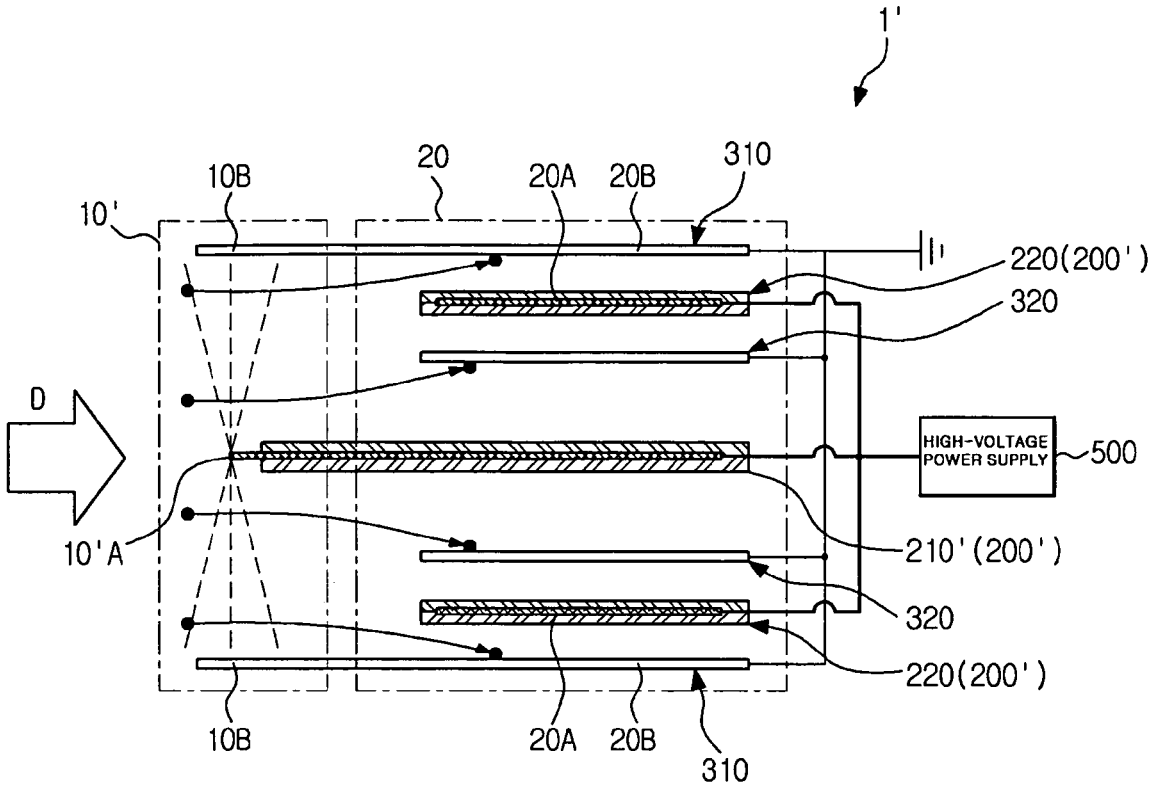
FIG. 7 is a schematic view illustrating the arrangement state of a high-voltage electrode and a low-voltage electrode applied to an electric precipitator according to another embodiment.
Figure 8:
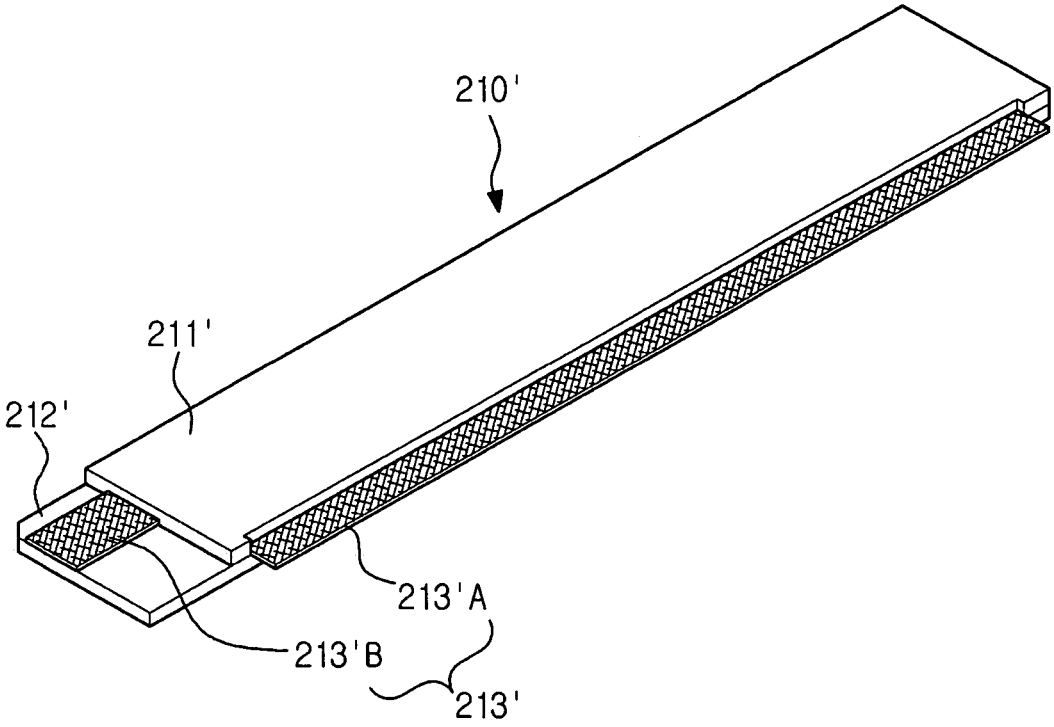
FIG. 8 is a perspective view of a first high-voltage electrode plate shown in FIG. 7.
Figure 9:
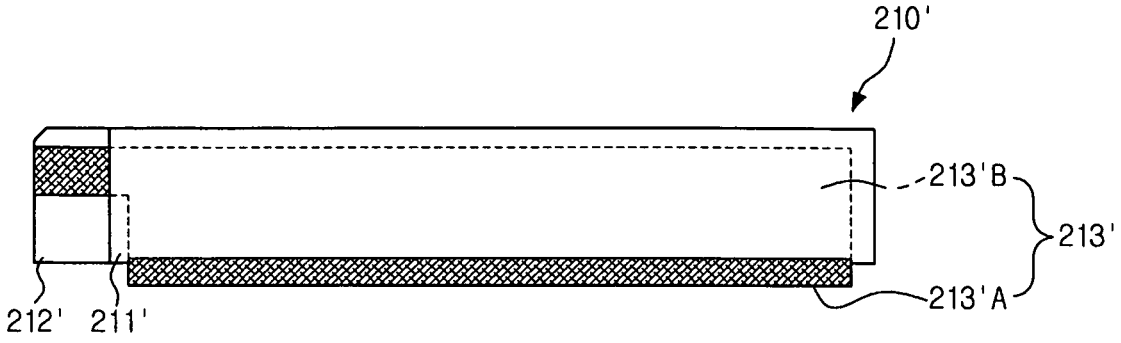
FIG. 9 is a plan view of the first high-voltage electrode plate shown in FIG. 8.
Figure 10:
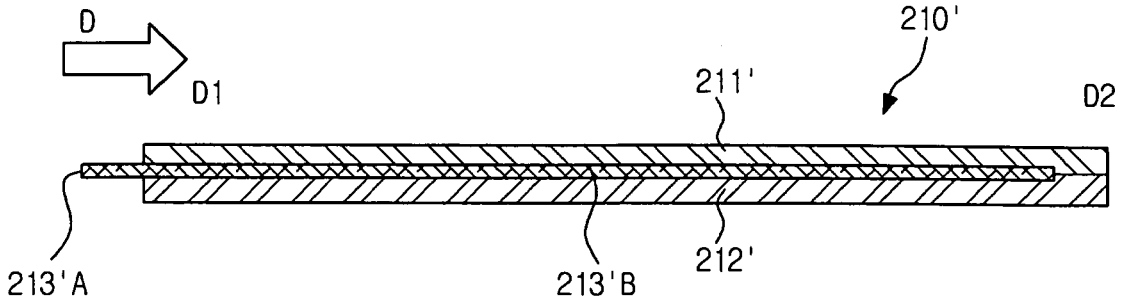
FIG. 10 is a side view of the first high-voltage electrode plate shown in FIG. 8.

FIG. 7 is a schematic view illustrating the arrangement state of a high-voltage electrode and a low-voltage electrode applied to an electric precipitator according to another embodiment, FIG. 8 is a perspective view of a first high-voltage electrode plate shown in FIG. 7, FIG. 9 is a plan view of the first high-voltage electrode plate shown in FIG. 8, and FIG. 10 is a side view of the first high-voltage electrode plate shown in FIG. 8.

As shown in FIGS. 7 to 10, an electric precipitator 1' according to another embodiment includes a plurality of high-voltage electrode plates 200' disposed in a frame (not shown) to collect contaminants, such as dust, and a plurality of low-voltage electrode plates 300 disposed in the frame so that the low-voltage electrode plates 300 correspond to the high-voltage electrode plates 200', the low-voltage electrode plates 300 and the high-voltage electrode plates 200' being alternately arranged.

In this embodiment, the high-voltage electrode plates 200' serve as discharge electrodes and collection electrodes of an electric precipitator having a two-stage electric precipitation structure, and the low-voltage electrode plates 300 serve as opposite electrodes and ground electrodes of an electric precipitator having a two-stage electric precipitation structure.

In this embodiment, the high-voltage electrode plates 200' and the low-voltage electrode plates 300 are alternately stacked at regular intervals to form an electrification region 10' and a collection region 20 in an air flow direction D.

Also, the high-voltage electrode plates 200' include first high-voltage electrode plates 210' each having a discharge electrode 10'A and a collection electrode 20A and second high-voltage electrode plates 220 each having only a collection electrode 20A. The low-voltage electrode plates 300 include first low-voltage electrode plates 310 each having an opposite electrode 10B and a ground electrode 20B corresponding to each of the first high-voltage electrode plates 210' and second low-voltage electrode plates 320 each having only a ground electrode 20B corresponding to each of the second high-voltage electrode plates 220.

Each first high-voltage electrode plate 210' includes first and second film members 211' and 212', formed of an insulative material, attached to each other and an electrode layer 213' provided between the first and second film members 211' and 212' in a state in which portions of the electrode layer 213' protrude outward from the first and second film members 211' and 212'.

The electrode layer 213' may be formed of a micro conductive fiber, such as a carbon fiber having a diameter of several μm to several tens of μm or a carbon nano tube. Portions of the electrode layer 213' protrude outward from the first and second film members 211' and 212', when the first and second film members 211' and 212' are attached to opposite main surfaces of the micro conductive fiber.

The electrode layer 213' includes a first part 213'A forming a discharge electrode 10'A at a protruding end having a length of several mm or less, for example 10 mm or less, and a second part 213'*b* forming a collection electrode 20A at the remaining portion excluding the protruding end.

Therefore, the first part 213'A of the electrode layer 213' constituting the discharge electrode 10'A to generate corona discharge between the first part 213'A and the opposite electrode 10B forms an electrification region 10' where contaminants, such as dust, are electrified.

When high voltage is applied to the electrode layer 213' of the first high-voltage electrode plate 210', therefore, corona discharge is generated between the electrode layer 213' of the first high-voltage electrode plate 210' and the opposite electrode 10B of a corresponding low-voltage electrode plate 300 which is spaced an appropriate distance from the first high-voltage electrode plate 210' to electrify contaminants, such as dust.

Also, the second part 213'B of the electrode layer 213' constituting the collection electrode 20A forms a collection region 20 where the contaminants electrified in the electrification region 10' are collected.

At this time, an electric field generated from the second part 213'B of the electrode layer 213' constituting the collection electrode 20A affects the electrification region 10', thereby increasing the intensity of the electric field in the electrification region 10'. As a result, particle electrification efficiency is improved, and therefore, particles electrified while passing through the electrification region 10 move a long distance.

Consequently, the distance between a first high-voltage electrode plate 210' including a first part 213'A of an electrode layer constituting a discharge electrode 10'A and a corresponding second low-voltage electrode plate 320 may be increased, as shown in FIG. 7. As a result, the number of electrode plates 210', 220, 310 and 320 disposed in the electric precipitator 1' may be decreased, thereby reducing material costs and pressure loss.

For example, on the assumption that the distance between a second high-voltage electrode plate 220 and a corresponding first low-voltage electrode plate 310 or between a second high-voltage electrode plate 220 and a corresponding second low-voltage electrode plate 320 is L, the distance between a first high-voltage electrode plate 210' and a corresponding second low-voltage electrode plate 320 may be 1.2 L to 1.5 L.

Meanwhile, when the electrode layer 213' is formed of a micro conductive fiber, discharge occurs at low voltage, thereby reducing the capacity of the high-voltage power supply 500 used in the electric precipitator 1' and reducing power consumption.

As described above, the electric precipitator according to embodiments of the present invention has a fundamental technical concept in which the electric field of the collection electrode forming the collection region affects the electrification region where contaminants, such as dust, are electrified to increase the intensity of the electric field in the electrification region. Therefore, various changes may be made by those skilled in the art within the scope of the fundamental technical concept of the invention.

As is apparent from the above description, both a discharge electrode to electrify contaminants and a collection electrode to collect the electrified contaminants on each low-voltage electrode plate are formed at each high-voltage electrode plate. Consequently, the width of an electric precipitator is greatly reduced, thereby more efficiently achieving space utilization.

Also, electrode layers, each of which uses even an electrification region as the collection electrode, are included, thereby improving electrification efficiency of contaminants, such as dust.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An electric precipitator comprising:

high-voltage electrode plates and low-voltage electrode plates alternately stacked to form an electrification region and a collection region in an air flow direction, wherein each of the high-voltage electrode plates comprises a discharge electrode to generate discharge between the discharge electrode and an opposite low-voltage electrode portion so that contaminants are electrified in the electrification region; and a collection electrode disposed over the electrification region and the collection region to collect the electrified contaminants in the collection region.

2. The electric precipitator according to claim 1, wherein each of the high-voltage electrode plates comprises:

first and second film members, formed of an insulative material, attached to each other;

first electrode layers provided at outer surfaces of the first and second film members to form the discharge electrode; and a second electrode layer provided between the first and second film members to form the collection electrode.

3. The electric precipitator according to claim 1, wherein each of the high-voltage electrode plates comprises:

first and second film members, formed of an insulative material, attached to each other; and an electrode layer provided between the first and second film members in a state in which portions of the electrode layer protrude outward from the first and second film members to form the discharge electrode and the collection electrode.

4. The electric precipitator according to claim 2, wherein the first electrode layers are carbon-ink printed on the outer surfaces of the first and second film members.

5. The electric precipitator according to claim 2, wherein the second electrode layer is disposed so that one end of the second electrode layer is adjacent to the first electrode layers.

6. The electric precipitator according to claim 2, wherein the second electrode layer comprises a first part formed at a downstream side in the air flow direction from a straight line connecting one end of the first electrode layer formed at the first film member and one end of the first electrode layer formed at the second film member.

7. The electric precipitator according to claim 6, wherein the second electrode layer further comprises a second part formed at an upstream side in the air flow direction from the straight line.

8. The electric precipitator according to claim 2, wherein the second electrode layer is disposed so that at least a portion of the second electrode layer faces the first electrode layers in a direction in which the high-voltage electrode plates are stacked.

9. The electric precipitator according to claim 3, wherein the electrode layer comprises:

a first part forming the discharge electrode at a protruding end having a length of several mm or less; and a second part forming the collection electrode at the remaining portion excluding the protruding end.

10. The electric precipitator according to claim 9, wherein the electrode layer is formed of a conductive fiber.

* * * * *